US005157819A

United States Patent [19]

Hodan

[11] Patent Number: 5,157,819

[45] Date of Patent: Oct. 27, 1992

[54] MODULAR YARN INTERLACER

[75] Inventor: John A. Hodan, Arden, N.C.

[73] Assignee: BASF Corporation, Parsippany, N.J.

[21] Appl. No.: 677,153

[22] Filed: Mar. 29, 1991

[51] Int. Cl.[5] ..... D02G 1/16

[52] U.S. Cl. ..... 28/271; 28/276; 28/274

[58] Field of Search ..... 28/271, 273, 274, 275, 28/276; 57/333, 350

[56] References Cited

U.S. PATENT DOCUMENTS 3,238,590 3/1966 Nicita et al. .
3,262,179 7/1966 Sparling .
3,286,321 11/1966 Fletcher et al. .
3,329,757 7/1967 Johnson .
3,751,775 8/1973 Psuras .
3,828,404 8/1974 Peckinpaugh et al. .
3,889,327 6/1975 Joly et al. .
3,994,121 11/1976 Adams .
4,063,338 12/1977 Wyatt ..... 28/221
4,666,395 5/1987 Shah .
4,719,837 1/1988 McConnell et al. .
4,754,527 7/1988 Gilhaus .
4,878,280 11/1989 Nelson et al. .
4,949,441 8/1990 Ethridge .

FOREIGN PATENT DOCUMENTS 3019302 11/1981 Fed. Rep. of Germany ..... 28/275

*Primary Examiner*—Werner H. Schroeder
*Assistant Examiner*—Bibhu Mohanty

[57] ABSTRACT

A yarn interlacer is provided which, being of modular construction, possess a greater versatility for processing yarns of different types.

10 Claims, 4 Drawing Sheets

MODULAR YARN INTERLACER

BACKGROUND OF THE INVENTION

This invention relates to an apparatus for interlacing a continuous multifilament yarn by passing the yarn through a yarn passageway and directing high pressure fluid from orifices onto the yarn.

Various types of apparatus are known for producing interlaced yarns, i.e., yarns possessing continuous multifilaments which have been subjected to an interlacing operation to provide the multifilaments with cohesion in place of twisting or twisting and sizing. An interlaced yarn is formed of continuous multifilaments which have been interlaced, i.e., commingled, entwined or entangled, in a disordered fashion forming "pseudoknots" in order to produce a yarn having an approximately zero overall twist. Such interlacing facilitates such downstream textile operations as beaming, sizing, weaving, twisting, tufting, knitting, and the like.

Known and conventional yarn interlacers subject the yarn moving under relatively low tension between two yarn guides in an interlacing zone to the action of a high velocity fluid stream, usually a jet of compressed air. In practice, the jet of compressed air is directed in a plane substantially transverse to the advancing direction of the yarn.

Important considerations in the design and fabrication of a yarn interlacer include the versatility of the apparatus for processing different types of yarn and achieving a variety of interlacing objectives In known and conventional yarn interlacers, e.g., those described in U.S. Pat. Nos. 3,262,179; 3,286,321; 3,751,775; 3,828,404; and 3,889,327, the yarn undergoing interlacing is passed through a passageway of fixed and unvarying configuration with the pressurized fluid outlets similarly bearing a fixed and unvarying relationship to the yarn. The fixed geometry of such interlacers necessarily limits their ability to process different types and constructions of yarns and produce a variety of interlacing effects.

SUMMARY OF THE INVENTION

It is an object of the invention to provide a yarn interlacer of modifiable configuration which can be readily and inexpensively manufactured.

It is a particular object of the invention to provide a modular yarn interlacer assembled from a series of plates in sandwich-like or laminate fashion, the number and specific sequence of the plates being readily altered to provide interlacers of varying configurations.

By way of meeting these and other objects of the invention there is provided a modular yarn interlacer comprising an assembly of intermediate plates which in registry cooperate to form one or more longitudinal yarn passageways, a longitudinal fluid inlet passageway, one or more fluid inlet channels connecting the fluid inlet passageway with the yarn passageway, and a pair of end blocks with the assembly of intermediate plates being positioned therebetween. The interlacer of the invention may also include one or more spacer plates which include no fluid inlet channels and/or which alter the diameter of the yarn passageway.

The modular construction of the yarn interlacer of this invention makes it possible to provide yarn processing passageways of different lengths and cross sections with the fluid inlet channels being distributed along the length of the yarn passageway in accordance with almost, any desired pattern. Thus, simple rearrangement of the number, type and positioning of the intermediate plates, each of which is placed in registry through a common alignment means, e.g., bolts extending the full length of the interlacer, permits the configuration of the interlacer to be altered for optimum interlacing of a particular yarn.

The present invention will be described more fully hereinafter with reference to the accompanying drawings, in which illustrative embodiments of the invention are shown. This invention can, however, be embodied in many different forms and the invention should not be construed as being limited to the specific embodiments set forth herein. Rather, applicant provides these embodiments so that this disclosure will be thorough and complete and will fully convey the scope of the invention to those skilled in the art.

DESCRIPTION OF THE PREFERRED EMBODIMENTS

Figure 2:
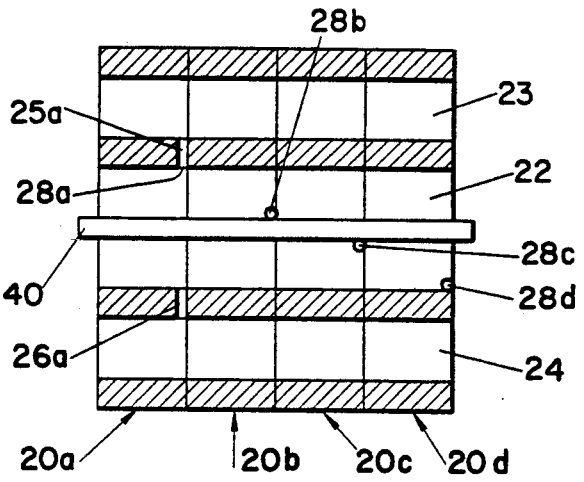
FIG. 2 illustrates, a longitudinal cross-sectional view of one arrangement of intermediate plates in a yarn interlacer in accordance with the present invention.
Figure 3:
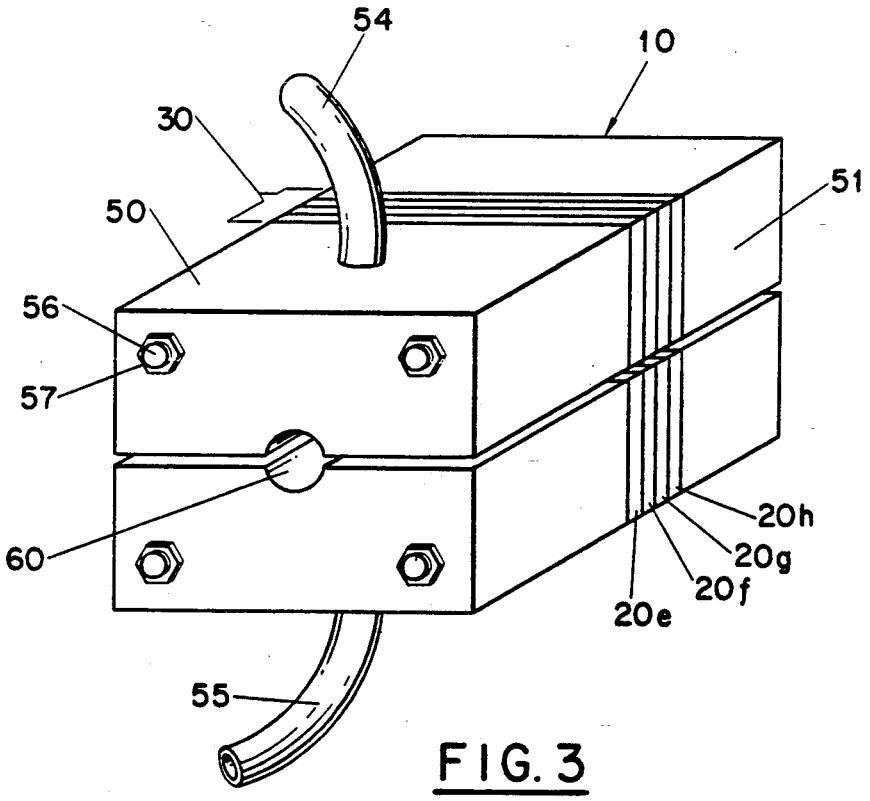
FIGS. 3 and 4 illustrate, respectively, a perspective view and an exploded perspective view of a fully assembled yarn interlacer in accordance with the present invention.
Figure 4:
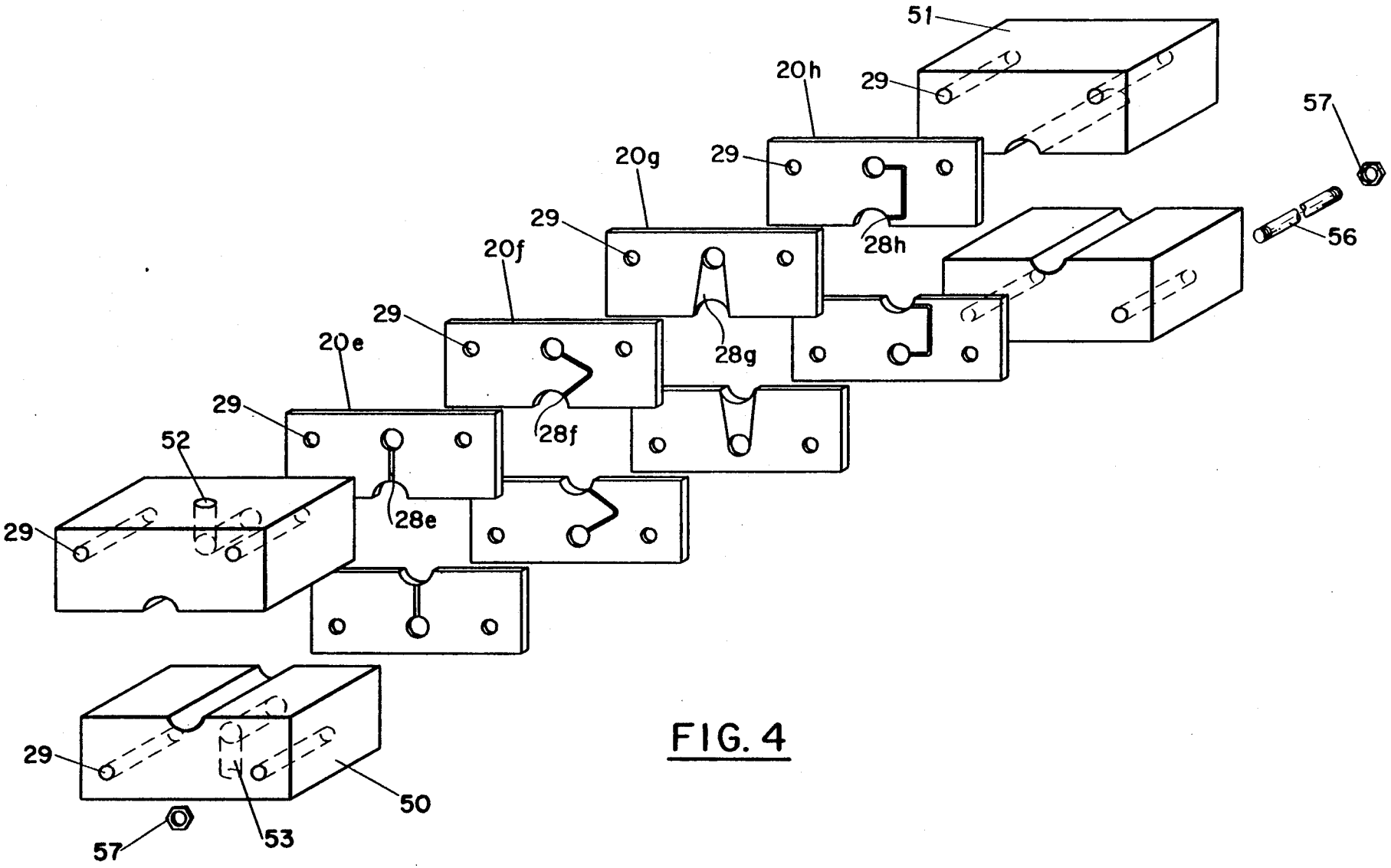

Referring now to the drawings, the modular construction of yarn interlacer 10 is made possible through the variable arrangement of a series of individual intermediate plates 20, specific configurations of which are shown in FIG. 2 as plates 20*a*, 20*b*, 20*c* and 20*d*, in FIGS. 3 and 4 as plates 20*e*, 20*f*, 20*g* and 20*h* and in each of FIGS. 5A–5J.

Figure 1:
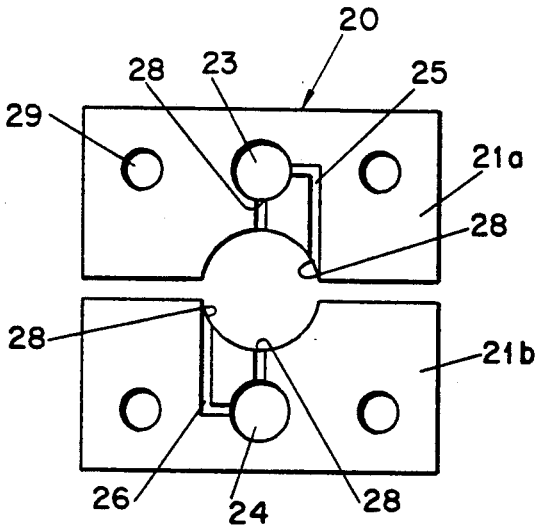
FIG. 1 illustrates a front view of an intermediate plate of a yarn interlacer in accordance with the present invention.

As shown in FIG. 1, an intermediate plate 20 is advantageously made up of half-plates 21*a* and 21*b* which are assembled and disassembled in clam shell fashion to facilitate string-up of the interlacer. Any suitable clamping means (not shown) may be used to secure the two sets of half-plates together. At a minimum, each intermediate plate 20 will possess one or more longitudinal yarn passageways 22, and at least one, preferably a pair of longitudinal fluid, inlet passageways 23, 24. In addition, one or more of the plates in the series will possess one or more transverse channels 25, 26 connecting fluid inlet passageways 23, 24 with yarn passageway 22. The geometries of passageways 22, 23 and 24 and channels 25 and 26 can vary considerably as can the positioning and/or the size of orifices 28 which open into the yarn passageway 22. One ordinarily skilled in the art will recognize that such geometries can be optimized for particular processes. As shown in FIG. 2, orifices 28*a*, 28*b*, 28*c*, 28*d* in successive intermediate plates 20*a*, 20*b*, 20*c* and 20*d* are positioned along the wall of yarn passageway 22 so as to form a spiral or helical pattern thereon. Other patterns can, or course, be readily obtained by simply varying the selection, number and/or arrangement of plates 20 making up intermediate section 30 of yarn interlacer 10. Aside from considerations of practicality, there is no intrinsic limit to the number or kinds of plates 20 that can be combined to provide the interlacer of this invention.

Figure 5A:
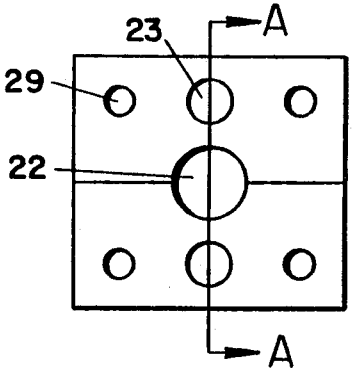
FIGS. 5A–5J illustrate front views of a variety of intermediate plates of a yarn interlacer in accordance with the present invention.
Figure 5B:
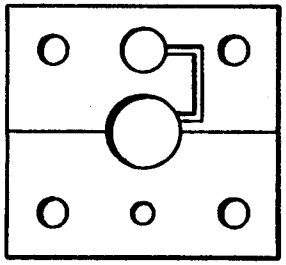
Figure 5C:
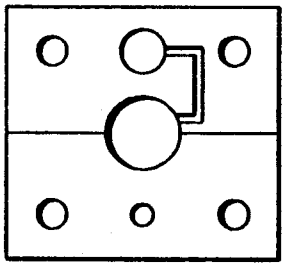
Figure 5D:
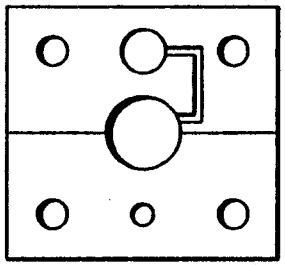
Figure 5E:
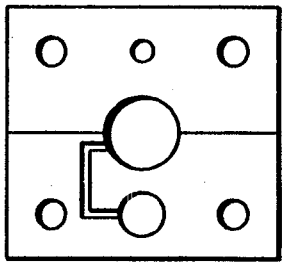
Figure 5J:
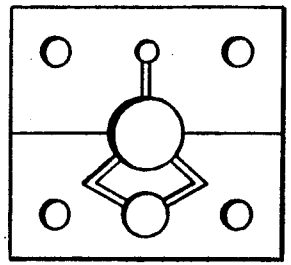
Figure 5F:
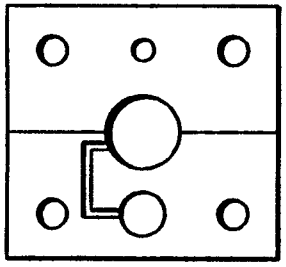
Figure 5G:
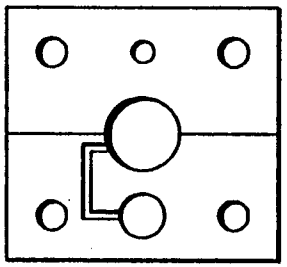
Figure 5H:
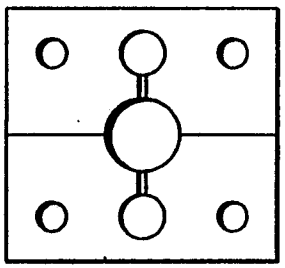
Figure 5I:
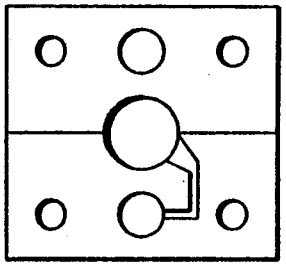

As seen in FIGS. 5A-5J, the channels formed in the intermediate plates can have a variety of patterns. FIG. 5A is a spacer plate which may be used in the interlacer of the invention, having no channel connecting fluid inlet passageway 23 with the yarn passageway 22. It should be noted that one can change the position of the orifices in the yarn passageway simply by rotating an intermediate plate 180 degrees. Thus, for example, the intermediate plate illustrated in FIG. 5C and the intermediate plate illustrated in FIG. 5F are the same, but are rotated 180 degrees. Similarly, the plates illustrated in FIGS. 5B and 5D are the same as the plates illustrated in FIGS. 5G and 5E, respectively, only rotated 180 degrees. Additionally, an advantage of having the intermediate plates divided into two half-plates is that various combinations of the halves may be assembled to provide different intermediate plate configurations. For example, the plates illustrated in FIGS. 5B-5G and 5I each include one half-plate which is of the spacer type illustrated in FIG. 5A. Also, the plate illustrated in FIG. 5J includes a top half of the type illustrated in FIG. 5H in combination with a different bottom half.

Figure 6:
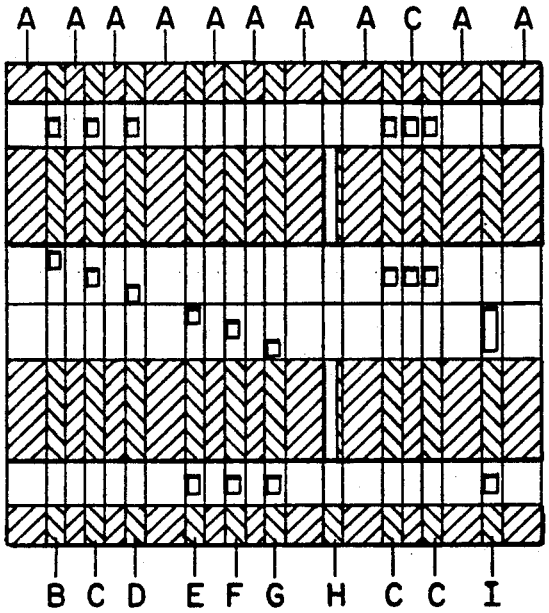
FIG. 6 illustrates a cross-sectional view of another embodiment of an interlacer in accordance with the present invention.

In FIG. 6 there is shown an illustrative embodiment of the invention composed of the various plates illustrated in FIGS. 5A-5I. In FIG. 6, the designations A, B, C, etc. correspond to the plates illustrated in FIGS. 5A, 5B, 5C, etc., respectively. The embodiment illustrated in FIG. 6 shows the advantageous use of spacer blocks (such as those illustrated in FIG. 5A) of varying thickness, as well as a variety of patterns which may be formed by the orifices by which fluid is introduced into the yarn passageway. Thus, for example, a spiral or helical pattern is formed along the yarn passageway by stacking the plates shown in FIGS. 5B-5H in sequence alternating with spacer plates of the type shown in FIG. 5A. As another example, an elongated horizontal jet of fluid is formed by placing several plates of the type illustrated in FIG. 5C in side-by-side relationship. An elongated vertical jet of fluid is created in the yarn passageway by employing the plate illustrated in FIG. 5I.

Figure 8:
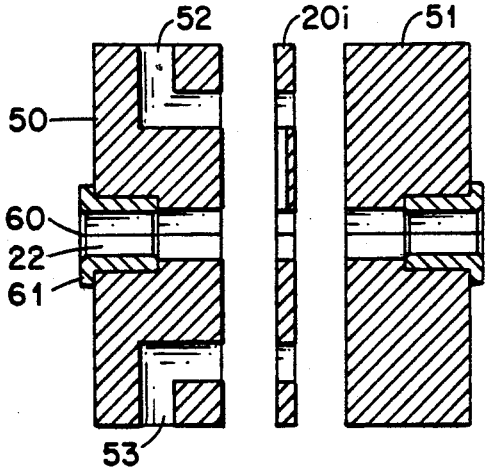
FIGS. 7 and 8 illustrate, respectively, an exploded perspective and a cross sectional view taken along line A—A of FIG. 7 of a presently preferred embodiment of an interlacer in accordance with the present invention.
Figure 7:
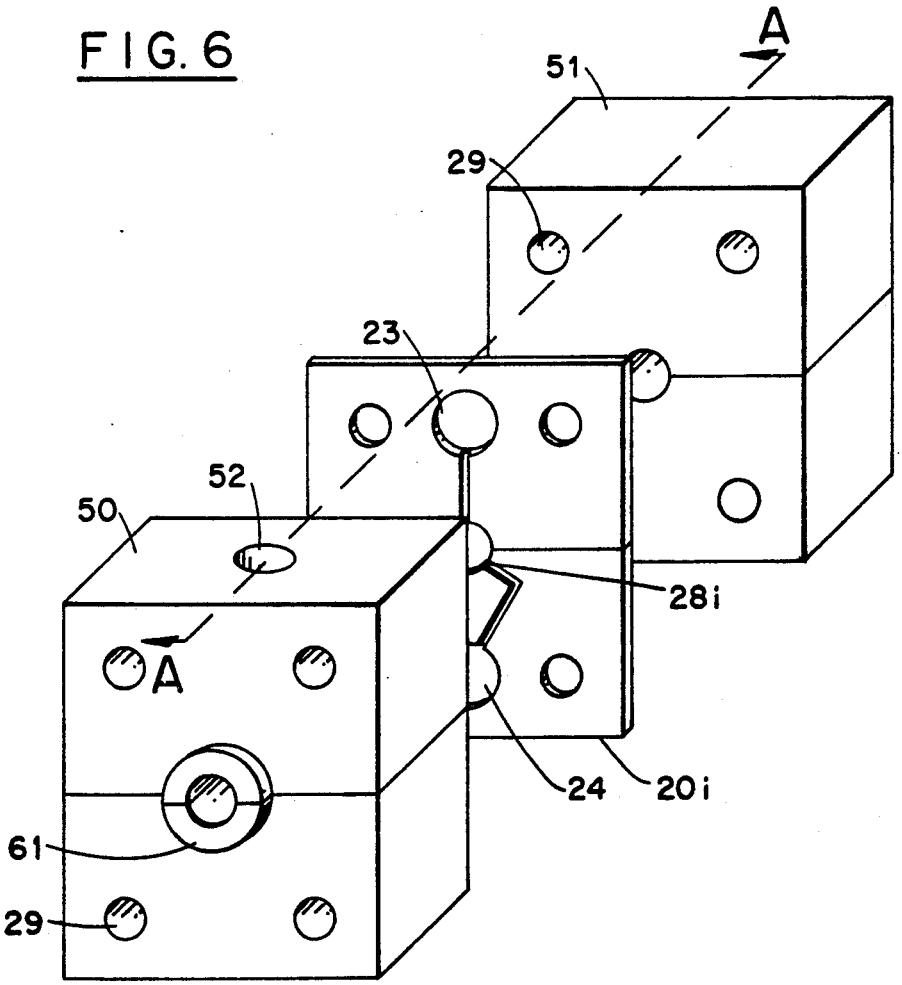

In FIGS. 7 and 8 there is shown a presently preferred embodiment of the invention composed of plate 20*i* and end blocks 50 and 51. The embodiment also illustrates the advantageous use of guide pieces 61 at entrance and exit ends of yarn passageway 22. Guides 61 prevent the abrasion of end blocks 50 and 51 by the moving yarn and reduce yarn fraying. The guide pieces may also be designed to advantageously position the yarn within the yarn passageway 22 to obtain a desired interlacing effect.

When assembling intermediate plates 20 possessing different diameters for one of the passageways therein, such passageway in the assembled intermediate section of the yarn interlacer will vary in diameter along its length. In this manner, the passageway, e.g., yarn passageway 22, can be made to abruptly or progressively increase, then decrease, in diameter along its length or a portion thereof.

Plate 20 can be manufactured from any suitable material, e.g., mild steel, stainless steel, brass, aluminum, plastic, etc. The plates and their various passageways and channels can be formed by any suitable manufacturing technique including die cutting, punching, stamping, drilling, etching, machining, electric discharge machining, molding, etc., or combinations thereof. Any suitable means may be employed to align intermediate plates in precise registry with each other and to maintain the assembled plates and their associated end blocks 50 and 51 in a tight fitting relationship. Thus, e.g., the intermediate plates and the end blocks can possess a series of evenly spaced apart apertures 29 which, in the assembled yarn interlacer, provide thruways accommodating terminallythreaded aligning bolts, or rods, 56. The bolts 56 extend beyond each end of the apparatus a sufficient distance to receive locking nuts 57.

The overall dimensions of the intermediate plates and end blocks can vary considerably according to the dimensions suitable for the process where the invention is used. In general, the plates and end blocks may have the same, or substantially the same, planar dimensions, e.g., from about 0.75 to about 1.5 inches in width and about 0.75 to about 1.5 in height. The plates can possess the same or different thicknesses, e.g., from about 0.015 to about 0.1 inches and the overall length of the fully assembled yarn interlacer can vary in the usual case from about 0.75 to about 2.0 inches, with a diameter ranging from about 0.1 to 0.3 inches.

End block 50 possesses ducts 52 and 53 (see FIG. 4) for receiving fluid inlet conduits 54 and 55 (see FIG. 3), respectively. Both end blocks possess passageways which cooperate with passageways 22 in intermediate plates 20 to form a single longitudinal yarn passageway. It should be understood that the yarn passageway 22 in end blocks 50 and 51 may be flared to form a converging/diverging configuration when assembled. It should also be understood that a pair of guide plates (not shown) which are made from a material which offers a minimum amount of friction against the yarn or fibers so as to reduce the possibility of yarn fraying may be used in lieu of guides 61 (FIG. 8). These plates are advantageously positioned adjacent to end blocks 50, 51 to protect the yarn as it enters and exits the ends of the yarn passageway. The holes through these guide plates have a diameter somewhat smaller than that of yarn passageway 22 to inhibit the yarn from being abraded by or abrading the interlacer. Suitable materials for these optional guide plates include, but are not limited to fluroplastics (like Teflon®), polished chrome platings, glass and ceramics.

In operation, yarn 40 advances under slight tension from a supply source into entrance end 60 of yarn passageway 22, passing therethrough to emerge at the other end of the interlacer unit (see FIG. 3). A pressurized fluid such as air or steam supplied to fluid inlet passageway 23 through conduit 54 (see FIG. 3) is directed by channels 25, 26 through orifices 28 against yarn strand 40 thereby effecting the interlacing of the yarn. Elevated pressure within yarn passageway 22 is relieved at either end thereof. The fluid introduced through orifices 28 exits the interlacer via either end of yarn passageway 22.

A major benefit provided by the modular approach to interlacer construction of the present invention is the ability to easily assemble a large variety of orifice configurations. As illustrated in FIGS. 1, 2, 6 and 7 the plates of the present invention can be stacked to form complex orifice arrangements that would be very difficult to machine conventionally Because interlacer design is largely empirical, the present invention provides the benefit of allowing evaluation of a large number of configurations using a limited number of parts.

The foregoing description is to be considered illustrative rather than restrictive of the invention, and those modifications which come within the meaning and range of equivalence of the claims are to be included therein.

I claim:

1. A modular yarn interlacer comprising:

a pair of end blocks; and an assembly of intermediate plates which in registry cooperate to form at least one longitudinal fluid inlet passageway, at least one fluid inlet channel connecting each fluid inlet passageway with a yarn passageway, and at least one longitudinal yarn passageway, said longitudinal yarn passageway is present through said end blocks and each plate in said assembly.

2. The modular yarn interlacer of claim 1 wherein each intermediate plate is made up of two halfplates.

3. The modular yarn interlacer of claim 1 wherein the intermediate plates and end blocks are maintained in registry by one or more bolts extending the length of the interlacer.

4. The modular yarn interlacer of claim 1 further comprising guide portions adjacent to said end blocks to protect the yarn from abrasion as it enters and exits said yarn passageway.

5. The modular yarn interlacer of claim 1 wherein said intermediate plates in registry cooperate to form a plurality of longitudinal yarn passageways.

6. A modular yarn interlacer comprising an assembly of a pair of end blocks and an intermediate plate which in registry cooperate to form at least one longitudinal yarn passageway, at least one longitudinal fluid inlet passageway and at least one fluid inlet channel connecting the fluid inlet passageway with the yarn passageway said yarn passageway is present through said end blocks and said intermediate plate.

7. The modular yarn interlacer of claim 6 wherein said intermediate plate is made up of two halfplates.

8. The modular yarn interlacer of claim 6 wherein the intemperate plate and end blocks are maintained in registry by one or more blots extending the length of the interlacer.

9. The modular yarn interlacer of claim 6 further comprising guide portions adjacent to said end blocks to protect the yarn from abrasion as it enters and exits said yarn passageway.

10. A method of interlacing fibers of multifilament textile yarn, the method comprising:

assembling an interlacer comprising intermediate plates which in registry cooperate to form at least one longitudinal yarn passageway, at least one longitudinal fluid inlet passageway, at least one fluid inlet channel connecting the fluid inlet passageway with the yarn passageway, and a pair of end blocks wherein the longitudinal yarn passageway is present through the end blocks and each intermediate plate in the assembly;

providing a source of high pressure fluid to said longitudinal fluid inlet passageway; and passing a multifilament textile yarn through said yarn passageway.

* * * * *

UNITED STATES PATENT AND TRADEMARK OFFICE

CERTIFICATE OF CORRECTION

PATENT NO. : 5,157,819

DATED : October 27, 1992

INVENTOR(S) : John A. Hodan

It is certified that error appears in the above-identified patent and that said Letters Patent is hereby corrected as shown below:

At column 6, line 15, please delete "intemperate" and put "intermediate" in its place.

At column 6, line 16, please delete "blots" and put "bolts" in its place.

Signed and Sealed this

Fifth Day of October, 1993

*Attest:*

*Attesting Officer*

Bruce Lehman

BRUCE LEHMAN

*Commissioner of Patents and Trademarks*